United States Patent [19]

Rickard

[11] 4,203,412

[45] May 20, 1980

[54] COMPOUND ARCHERY BOW

[76] Inventor: Lawrence C. Rickard, 116 Pine Tree Ave., Lake Worth, Fla. 33460

[21] Appl. No.: 907,909

[22] Filed: May 22, 1978

[51] Int. Cl.[2] ..... F41B 5/00

[52] U.S. Cl. ..... 124/23 R; 124/88; 124/90

[58] Field of Search ..... 124/23 R, 24 A, 41 A, 124/90, 88, 86

[56] References Cited

U.S. PATENT DOCUMENTS

| | | | |
|---|---|---|---|
| 3,967,609 | 7/1976 | Frydenlund | 124/90 X |
| 3,989,026 | 11/1976 | Nishioka | 124/88 X |
| 4,103,667 | 8/1978 | Shepley | 124/88 X |

*Primary Examiner*—William R. Browne
*Attorney, Agent, or Firm*—Malin & Haley

[57] ABSTRACT

An archery bow wherein the draw weight increases as a function of draw displacement to a point just short of maximum draw displacement, such that the draw weight is substantially reduced at maximum draw string displacement.

First and second levers fixed together at approximately a 90 degree angle are rotatably coupled to a support arm fixed to the bow body. The bow string is anchored at each end to the first lever ends and disposed about pulleys connected at the bow limb ends. Separate limb tension cables are anchored between the limbs and pivotal rollers connected at the ends of the second lever. Rotation of the second lever (and pivotal rollers) approximately 90 degrees by displacing the bow string toward its maximum position causes each roller to move onto a fixed flat surface, substantially reducing the draw weight on the bow string just short of maximum draw displacement. Each roller-receiving flat surface, which is fixed to the support arm has a surface inclination relative to the tensional pull direction of each tension cable from the bow limb. When the rollers are engaged on the flat surface, maximum draw weight is significantly reduced.

In an alternate embodiment, the surface angle of inclination of the roller receiving surface is variable by a thumb engaging bar to vary the substantially reduced draw weight at maximum draw displacement between 0 to approximately 15 pounds.

1 Claim, 9 Drawing Figures

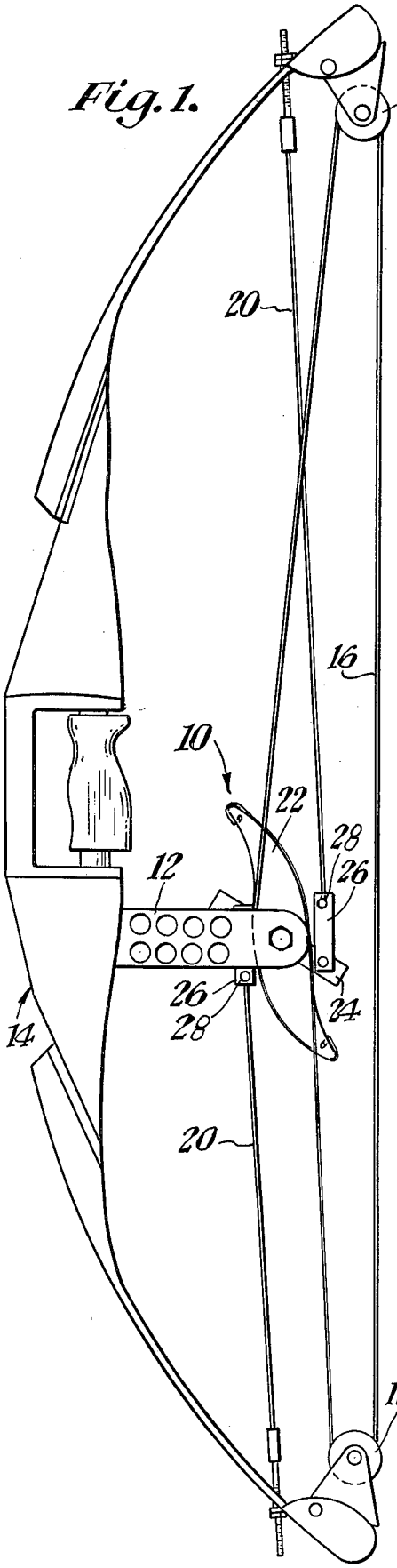
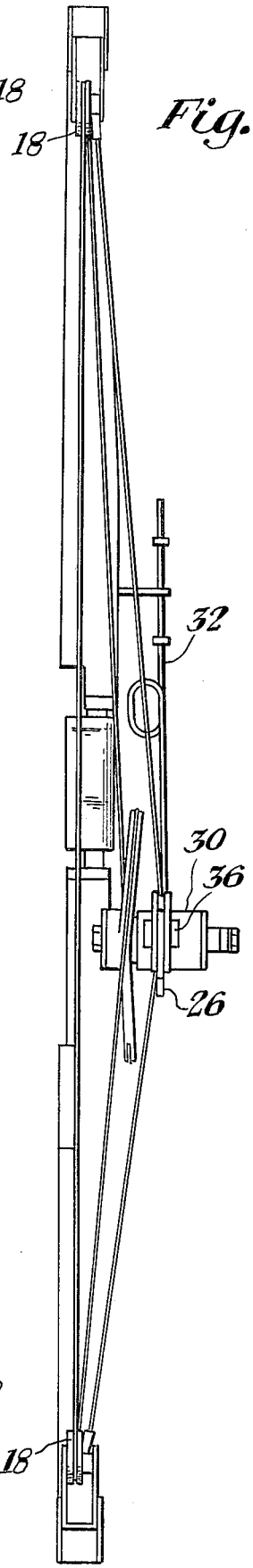
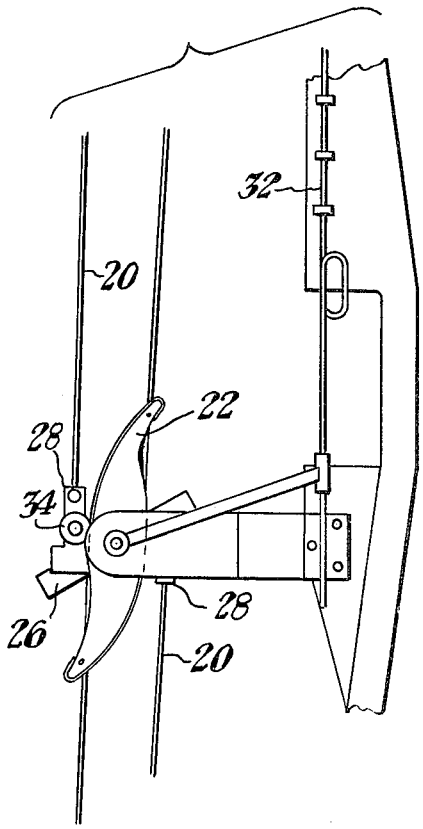
Fig. 3.

COMPOUND ARCHERY BOW

BACKGROUND OF THE INVENTION

This invention relates generally to an archery bow that has a manually variable, substantially reduced draw weight near and at maximum bow string displacement, and specifically to a bow in which the draw weight at maximum bow string displacement can be manually varied by the bowman while holding the bow string at maximum displacement. The bow further provides for a smooth yet extremely powerful release of force when the bow string is released at maximum displacement.

There have been several prior art bows shown that provide for force reduction at maximum bow displacement. Examples would be U.S. Pat. No. 3,923,035 issued to Trotter on Dec. 2, 1975 which shows a compound bow which utilizes eccentric cams in conjunction with a plurality of tensioning cables and pulleys to provide for reduced bow string weight. Additionally, force multiplying type bows are shown such as in U.S. Pat. No. 3,854,467 issued to Hofmeister on Dec. 17, 1974 which shows a plurality of pulleys and cables using eccentric actuation for force multiplication. Another compound archery bow is shown in U.S. Pat. No. 3,841,295 that includes a plurality of pulleys and cams to achieve reduction of draw weight beyond or at maximum displacement. Since the prior art bows are quite complex in construction and operation, they require interaction with pairs of devices connected to the limbs, and they utilize eccentric cam mechanisms that are mechanically complicated to effect force reduction while not providing for a sharp dropoff of force or draw weight at maximum displacement. The present invention provides for a noncomplex, double-levered force or draw weight reducing mechanism which can be manually adjustable and varied while the bowman has the string drawn to its maximum displacement. Another feature of the invention is that the force dissipation on the bow string is smooth upon release of the bow string from its maximum displacement position such that the arrow receives maximum uniform force available.

BRIEF DESCRIPTION OF THE INVENTION

An improved archery bow comprising a bow frame having an upper and lower limb, a pair of pulleys disposed at the free ends of each limb, a bow string connected through each pulley, and a rigid supporting arm connected to the bow frame and disposed horizontally toward the bow string.

Mounted on the rigid supporting arm are first and second levers which are fixed together at a 90 degree angle and which rotate relative to the rigid supporting arm. The ends of the bow string are anchored to the ends of the first lever. Located at each end of the second lever is a pivotal bar having a roller connected thereto. Each pivotal bar and roller are anchored to the tensioning cable disposed between each limb such that rotation of the second lever causes each bow limb to tension. Each roller when rotated by movement of the levers moves in a path to engage a fixed, inclined surface rigidly connected to the supporting arm such that the tension direction on the tension cable pulls downwardly on the roller, when the roller engages the inclined surface. Thus, the tension force of the bow string is held in a frictional relationship by the interaction of the roller on the inclined surface and the tension force from the anchored portion of the tension cable.

In one embodiment, the inclined surface angle relative to the tensioning force cables direction may be manually varied even while the bow string is at maximum displacement by the bowman by moving an actuating arm to vary the surface inclination.

The rollers are positioned to engage the inclined surface at a position just short of the maximum draw displacement such that for the first major portion of draw string pull, tension on the draw string will increase uniformly. Upon reaching a position near maximum bow string displacement (when the rollers commence engaging the inclined surface), the pull force on the bow string is greatly reduced by the frictional force reaction when the rollers are pressed against the inclined surface by tension on the limb tension cables. This effect and the particular angle of inclination allows for variable adjustments of draw weight at maximum displacement at anywhere from 0 to 15 pounds or more.

For the functioning of the devices as shown in the instant invention, as tension on each limb tension cable increases, approaching a peak maximum displacement, the roller commences engaging an inclined surface near the maximum displacement. The limb tension cable connected to the roller causes a force on the roller downwardly on the inclined surface. A force vector is established on the axis of each roller that may be mathematically resolved into a vector perpendicular to the inclined surface and parallel to the inclined surface. The angular relationship of the roller-receiving surface and the tension cable establishes a force vector relationship to reduce cable tension, the (draw weight on the bow string) when the roller rests on a particularly angled surface relative to the tension cable. A pair of tension cables are provided, each extending from each limb of the bow such that a pair of rollers are used with the tension cables being anchored to the pivotal rollers on each side. Thus, in this embodiment, a rigid housing is connected to the supporting arm which has two inclined surfaces which are substantially parallel such that a pair of rollers cooperate with the pair of inclined surfaces.

In one embodiment, as an example of the utilization of the present invention, the peak draw force is measured to occur at approximately 28 inches of the bow string displacement. At 30 inches, which is maximum bow string displacement, utilizing this particular bow, the draw force dropped to approximately 10 pounds. It can be seen that there is a sharp slope when measuring draw force versus draw bow string displacement approaching its maximum displacement occuring between the peak draw force and maximum displacement of the draw string. The amount of force or draw weight required at maximum draw can be adjusted, utilizing the instant invention such that in one embodiment, it may be preset and fixed in the bow for any value from 0 upwardly as desired by fixing the angular incline of the roller engaging surface relative to the direction of the tension cable. In an alternate embodiment, a moveable arm is included that engages the thumb of the bowman such that while the bow is being maintained at maximum displacement, the amount of force or the draw weight at maximum may be varied from 0 to a variable predetermined amount.

It is an object of this invention to provide an improved archery bow which allows for varying and reducing the draw weight at maximum draw string displacement.

It is another object of this invention to provide an archery bow with an improved bow force dissipation that greatly reduces the draw weight at draw string maximum displacement.

But yet, still another object of this invention is to provide an improved compound type bow which allows for a variable setting of draw weight at maximum bow string displacement while eliminating eccentric cam devices.

And yet, still another object of this invention is to provide an archery bow of increased performance and accuracy which includes a reduced draw weight at maximum draw string displacement.

In accordance with these and other objects which will be apparent hereinafter, the instant invention will now be described with particular reference to the accompanying drawings.

BRIEF DESCRIPTION OF THE DRAWINGS

FIG. 1 shows a side elevational view of an archery bow employing the instant invention.

FIG. 2 shows a back elevational view of an archery bow with applicant's invention.

FIG. 3 shows a side elevational view that is fragmentary showing applicant's invention.

PREFERRED EMBODIMENT OF THE INVENTION

Figure 4:
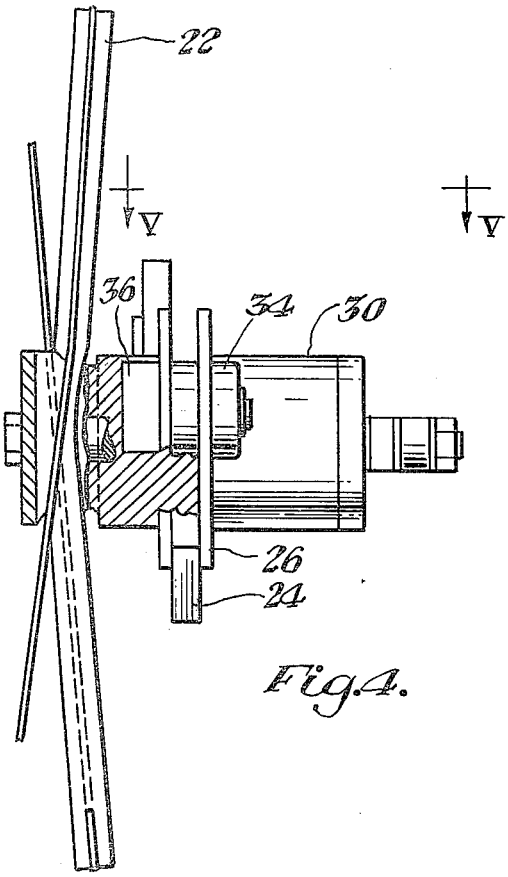
FIG. 4 shows a back elevational view partially in cross-section of the lever mechanism utilized in the instant invention.

Referring now to the drawings and especially FIG. 1, the instant invention is shown generally at 10 attached by a rigid mounting arm 12 to bow frame 14. The primary bow drawstring 16 is coupled through pulleys 18 mounted at the ends of the bow limbs and anchored to a first lever 22 at each end of the lever. The lever includes channels for receiving and guiding the bow string along the lever body. The first lever 22 is rotatably mounted on supporting arm 12 and rotates approximately 90 degrees when bow string 16 is extended to its maximum displacement position. A second lever 24 is rigidly fixed to first lever 22. A pair of pivotal arms 26 are anchored to bow limb tensioning strings 20 at each end.

Displacement of the primary bow string 16 causes the first lever 22 to rotate (clockwise as shown in FIG. 1), also effecting rotation of second lever 24. This action tensions the bow through the limb tensioning strings 20. Looking at FIG. 2, housing 30 is shown which is rigidly fixed to supporting plate 12 and includes an inclined plane 36 on each side which receives rollers (not shown in FIG. 2) affixed to pivotal arms 26 connected to second lever 24 pivotally. In the maximum draw string extended position, the rollers rest on surface 36. The action of the rollers is explained in greater detail below.

FIGS. 2 and 3 show an actuating arm 32 connected to surface 36 to effect the angular adjustment of surface 36 to vary the draw weight force required to hold the bow string at maximum displacement. The actuating arm 32 rotates a member 38 (FIG. 6) disposed within housing 30 (FIG. 5) to position the angle of inclination of surface 36 relative to the tension string direction and functions independently of the first and second levers 22 and 24 respectively.

Figure 6:
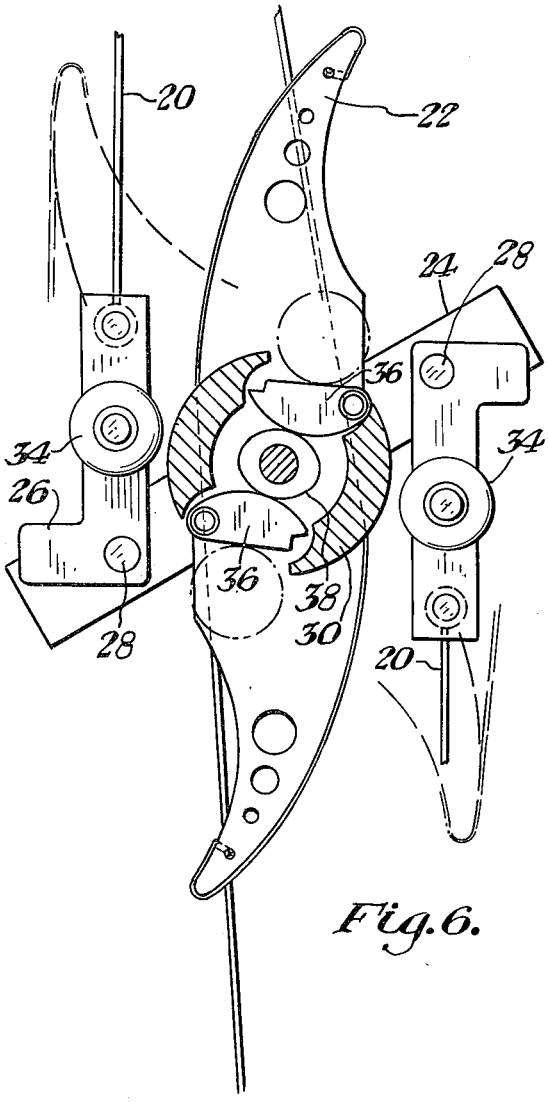
FIG. 6 shows a side elevational view partially in cross-section of the actuating mechanism as utilized in the instant invention.
Figure 5:
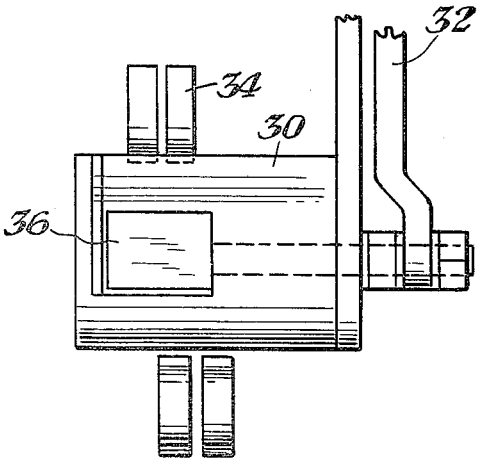
FIG. 5 shows a fragmentary elevational view of the weight draw force reduction mechanism in accordance with the instant invention.

FIGS. 4 and 5 show the housing 30 which is mounted on the support arm (not shown) having the flat surface area 36 which receive a pair of rollers 34 pivotally mounted on second lever 24 by pivot arm 26. Referring to FIG. 6, the action of the first and second levers and rollers are shown which act to rotate first lever 22 and second lever 24 when the bow string is moved toward its maximum displacement position. The rotation of the two levers positions rollers 34 so that they are resting under tension on surfaces 36. As the second lever arm rotates, roller 34 on each side which is connected to the tensioning string 20 and being pulled against it, ultimately at maximum bow string displacement rests on the upper flat portion of the surface 36 such that the tension on tension string 20 acts to pull the roller in a downward engagement frictionally retarding movement of the roller, greatly reducing the draw holding weight on the primary bow string. The frictional force caused by the tension on tension string 20 between the inclined surface 36 and the roller 34 retards and holds the bow in tension while still providing a sufficient force to permit some movement or rolling of the roller down the plane which allows for disengagement of the roller. As the bow string is released from maximum displacement position, each roller moves under the tension of the tension strings to a position where it clears the inclined surfaces 36 thus allowing the tensioning strings 20 to pull freely which causes rotation of the first lever 22 allowing the string to expend its potential energy back to the neutral position. Thus, as shown in FIG. 6, the lever arm 24 will rotate causing the roller on the left side 34 to rotate downwardly against the tension of limb tensioning string 20 until the roller engages surface 36 which acts to hold against the tension 20 on the string. The angle of surface 36 is set by movement of the actuating arm 32 (FIG. 5) which is connected to element 38 which has an eccentric surface which can raise or lower the pivotal surface 36 to the desired position. The change of the angle effects the angle of inclination altering the draw string maximum displacement weight.

Figure 7:
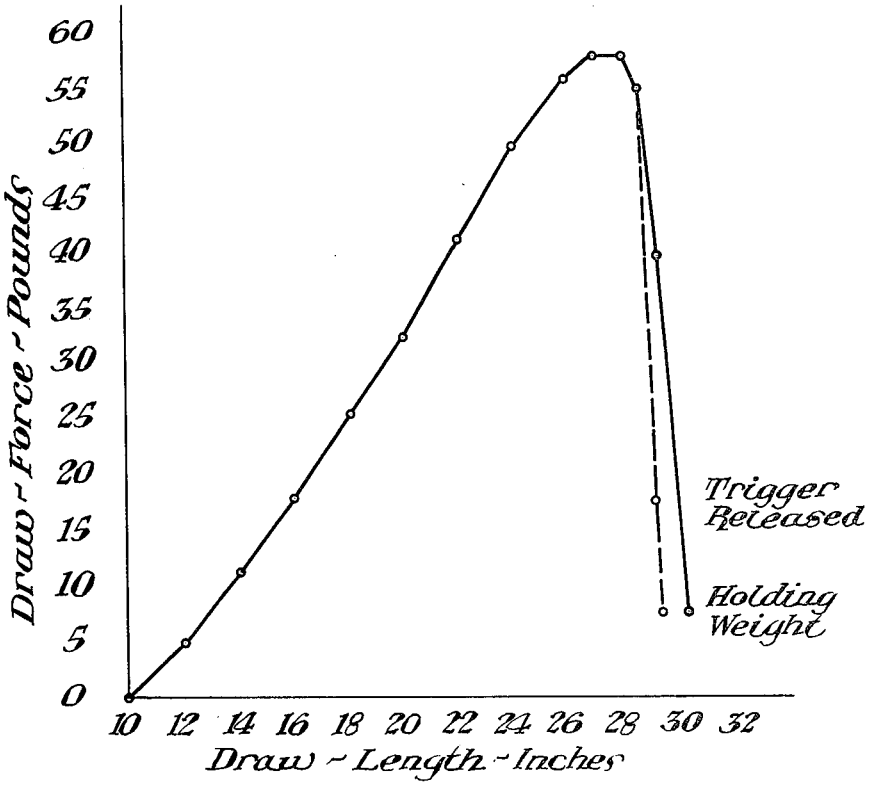
FIG. 7 shows the draw weight displacement graph showing characteristics of the instant invention.

FIG. 7 shows a representative diagram or graph showing the draw length in inches of the main bow string versus the draw force in pounds. Once the draw length reaches around 26 to 27 inches, note the sharp decrease in draw force back to the maximum length of 30 inches. At the maximum displacement, movement of the actuating arm can vary the final holding weight from approximately 0 to 15 pounds. Slight movement away from the maximum back towards the bow frame provides for a swift return to the maximum draw force available as shown by the graph.

Figure 9:
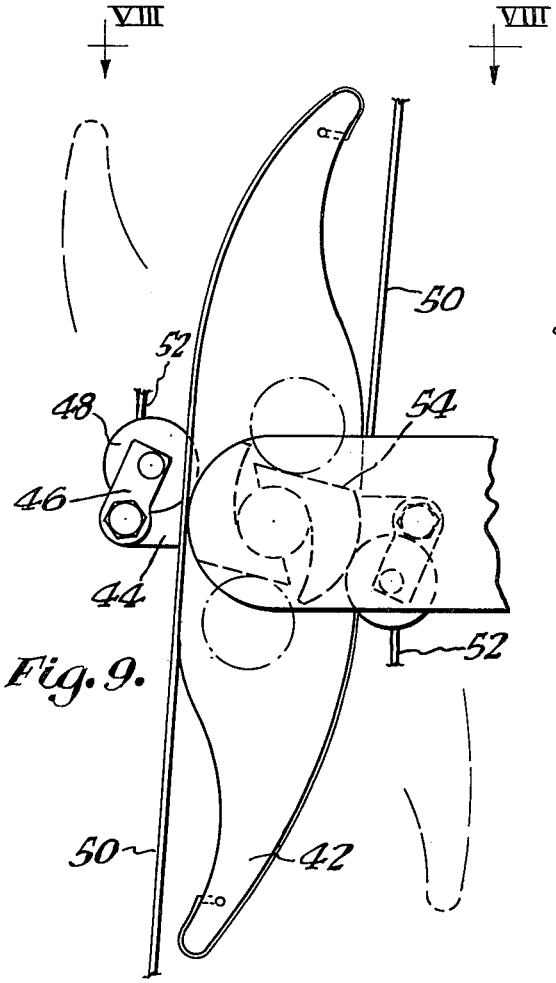
FIG. 9 shows a side elevational view of the alternate embodiment shown in FIG. 8.
Figure 8:
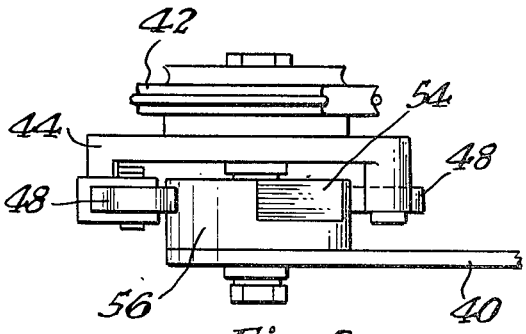
FIG. 8 shows a top plan view of an alternate embodiment of the instant invention.

FIGS. 8 and 9 show an alternate embodiment in which single rollers are used in conjunction with an essentially fixed incline plane surface 54. As shown, the lever 42 and lever 44 are rigidly fixed together as described above and include a pair of pivotal arms 46 which house single rollers 48 at each end. Affixed to the roller shaft are the limb tensioning strings 52 on each side. The surface 54, which represents the inclined plane upon which the rollers ultimately rest, is fixed relative to the housing 56. The principle of operation of the engagement of the pivotal rollers on the inclined surface 54 remains essentially the same.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An archery bow in which the draw weight is greatly reduced at maximum draw string displacement comprising:

a bow frame having a pair of bow limbs;

a primary draw string connected to said bow limbs;

a supporting arm connected to said bow frame;

first and second levers rigidly fixed together and rotatably mounted on said supporting arm;

the primary draw string connected intermediate its ends to said limbs and at each end thereof to the respective ends of said first lever;

a pair of limb tensioning strings that are tensioned by operation on said primary draw string, each said tensioning string being connected intermediate its ends to one of said bow limbs and to said second lever ends;

first and second rollers each said roller being pivotally attached to an end of said second lever arm, and said bow frame including an inclined surface rigidly coupled to said support arm to receive one of said rollers when the primary draw string has reached its maximum displacement.

* * * * *